United States Patent [19]

Marelli

[11] Patent Number: 4,597,671

[45] Date of Patent: Jul. 1, 1986

[54] APPARATUS FOR EMULSIFYING AND ATOMIZING FLUID FUELS WITH SECONDARY FLUIDS, IN PARTICULAR WATER

[76] Inventor: Ernesto Marelli, Via Segré, 3-Monza (Province of Milano), Italy

[21] Appl. No.: 605,454

[22] Filed: Apr. 30, 1984

[30] Foreign Application Priority Data

May 3, 1983 [IT] Italy ..... 20916 A/83

[51] Int. Cl.[4] ..... B01F 15/02

[52] U.S. Cl. ..... 366/127; 366/173; 366/336; 123/25 E

[58] Field of Search ..... 123/25 R, 25 A, 25 E, 123/25 F; 366/127, 139, 160, 161, 162, 163, 165, 167, 173, 177, 182, 336, 340, 341; 431/163

[56] References Cited

U.S. PATENT DOCUMENTS

| | | | |
|---|---|---|---|
| 703,566 | 7/1902 | Fox | 431/163 |
| 4,019,721 | 4/1977 | Langner | 366/161 |
| 4,052,139 | 10/1977 | Paillund et al. | 123/25 A |
| 4,071,225 | 1/1978 | Holl | 366/127 |
| 4,210,166 | 7/1980 | Munie | 366/160 |
| 4,333,422 | 6/1982 | Mahoney | 123/25 E |

FOREIGN PATENT DOCUMENTS

| | | | |
|---|---|---|---|
| 756060 | 8/1980 | U.S.S.R. | 123/25 E |

*Primary Examiner*—Robert W. Jenkins
*Assistant Examiner*—Arthur D. Dahlberg
*Attorney, Agent, or Firm*—Guido Modiano; Albert Josif

[57] ABSTRACT

An apparatus is disclosed for emulsifying and atomizing fluid fuels with secondary fluids, in particular water, which has improved characteristics over commercially available apparata especially as regards the maximum mixable proportion of secondary fluid without undergoing efficiency deterioration, stability, and homogenization level. The apparatus comprises a first mechanical cavitation chamber wherein the fluid fuel and water are mixed and pretreated, a combined action cavitation chamber of a mechanical and electromagmetic type, and a final cavitation chamber, wherein homogenization of the fluid is completed. The combined actions within the intermediate chamber are achieved by generating within the chamber a centered corridor resulting from the effects of high pressure and vacua, and of an appropriate magnetic field. The invention also provides a method of treating fuel fluids by means of the apparatus illustrated.

4 Claims, 6 Drawing Figures

APPARATUS FOR EMULSIFYING AND ATOMIZING FLUID FUELS WITH SECONDARY FLUIDS, IN PARTICULAR WATER

BACKGROUND OF THE INVENTION

This invention relates to an apparatus for emulsifying and atomizing fluid fuels with secondary fluids, in particular water.

Long available commercially have been emulsifiers for emulsifying a variety of fluids, such as fluid fuels of the kind of fuel oil, naphta, and other thick fuels, with water which serve the function of mixing the fuel with the liquid in order to improve fuel economy, with obvious advantages of an economical and energy character. Commercially available emulsifiers operate on different principles; as an example, known are mechanical systems, systems operating on mechanical chemical principles, and ultrasonic or catalytic apparata. Such systems, irrespective of the principles on which they are based, cannot provide a high specific power, and while affording different effectiveness levels, in all cases provide inadequate levels.

Furthermore, from European Patent Application No. 82101101.2 filed on Feb. 15, 1982, an ultrasonic apparatus is known, wherein a piezoelectric transducer energized by a generator of periodic waves comprises a base block associated with a flow line for the product being treated which comprises fuel and water, and wherein associated with the base block are a plurality of piezoelectric pads interleaved with electric contacts with different polarities electrically connected to the generator and clamped onto the base block by means of a counterblock.

The apparatus just described, thanks to its constructional features, affords considerably higher specific power than prior systems, and consequently a much more effective treatment of the fluids to be emulsified.

SUMMARY OF THE INVENTION

In view of the above situation, it is the aim of this invention to provide an apparatus for emulsifying and atomizing fluid fuels with secondary fluids, in particular water, which can give even better results than the apparatus just mentioned.

Within that aim, it is a particular object of this invention to provide such as apparatus which can improve fuel economy still further thanks to a reduction in the proportion of fuel used, while retaining the same level of efficiency or even improving on it.

Still another object of this invention is to provide such an apparatus which can afford a particularly stable and homogenized final product.

Another object of this invention is to provide such an apparatus which can afford a reduction in the excess air to be fed during combustion.

A further object of this invention is to provide such an apparatus, which allows admixing to the fuel of an amount of water up to 60% of the total product, and the use of water of any hardness and with a pH value in the 4 to 12 range.

A not unimportant object of this invention is to provide such an apparatus for emulsifying and atomizing fuel with water, which can yield a very high specific power, far above that achievable with prior techniques.

The above aim, and these and other objects such as will be apparent hereinafter, are achieved by an apparatus for emulsifying and atomizing fluid fuels with secondary fluids, in particular water, according to the invention, comprising separate inlets for the fluid fuel and secondary fluids to be emulsified together, and mechanical cavitation chambers, characterized in that it comprises at least one combined mechanical and electromagnetic action cavitation chamber adapted to generate within the chamber itself a centered corridor wherethrough said fuels and fluid and secondary fluid, as already mixed together, are caused to flow.

BRIEF DESCRIPTION OF THE DRAWINGS

Further features and advantages will be more clearly understood from the following detailed desciption of a preferred, but not exclusive, of an apparatus for emulsifying and atomizing fluid fuels with secondary fluids, in particular water, as illustrated by way of example and not of limitation in the accompanying drawings, where.

DESCRIPTION OF THE PREFERRED EMBODIMENTS

Figure 1:
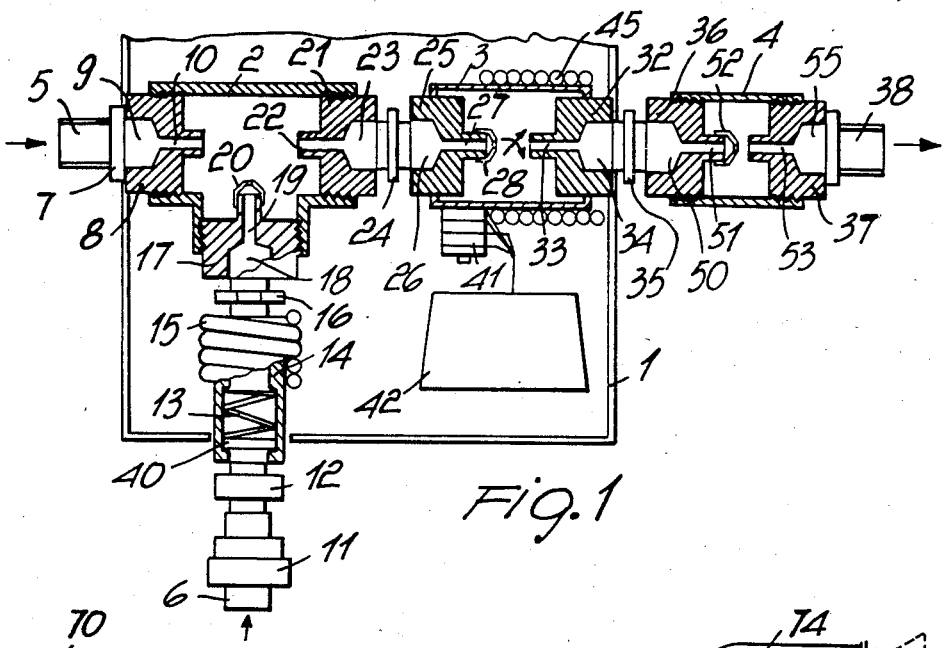
FIG. 1 is a cross-sectional view taken through the apparatus according to the invention.

Making reference to FIG. 1, the apparatus for emulsifying and atomizing fluid fuels with secondary fluids, in particular water, according to the invention, essentially comprises a box-like body 1 accommodating on its interior a first mechanical cavitation chamber 2 and a combined mechanical-electromagnetic action cavitation chamber 3, and a second mechanical cavitation chamber 4. In particular, indicated at 5 is an inlet for the fluid fuel and at 6 is a secondary fluid inlet, in particular for water. The fluid fuel inlet 5 includes an elastic joint adapted to withstand high pressures and temperatures, and is followed by an abutment 7 of an elastic-mechanical type having like characteristics which leads into an injector 8 comprising a resonant body penetrated by a channel having a first, enlarged cross-section, which forms a compression chamber 9, and a second, smaller cross-section which forms the injection channel 10 proper. The water inlet 6 is connected to a three-piece joint 11 provided with conical seats on its interior which are adapted to withstand high pressures and temperatures and not shown in the drawing. Downstream of the joint 11 is an elastic joint 12 which leads into a hollow body 14 of the resonant type wherein water is pretreated and which includes a high pressure check valve so as to arrange for the preliminary electromagnetic action on water. Indicated at 13 is the mechanism for the check valve provided with an elastic body, and indicated at 40 is the valve checking arrangement.

Around the resonant body 14 is a winding 15 capable of generating an electromagnetic field within the body itself. Downstream of the resonant body 14, with the interposition of an elastic joint 16, is the injector 17 which includes a resonant body formed on its inside with a conduit having a first, enlarged cross-section which forms the compression chamber 18, and a second, reduced cross-section which forms the ejection tunnel 19. The resonant body 17 further comprises an injector 20 for the secondary fluid. On one side of the first cavitation chamber 2, which as may be seen has a substantially T-like shape, there is located the outlet for the fluid formed by fuel and secondary fluid mixture, after said resulting fluid has undergone a first mechanical cavitation treatment. The outlet comprises a resonant body 21 penetrated by a conduit having a first, reduced cross-section which forms the channel 22 and a second, enlarged cross-section which forms the expansion chamber 23. Located at the outlet 21 is an elastic joint 24 having high properties of resistance to pressure and temperature, which leads into the inlet to the combined action cavitation chamber 3. That inlet comprises a resonant body 25 of similar configuration to the resonant body 17, that is, comprises a first compression chamber 26, an ejection tunnel 27, and an injector 28. As may be seen, located outside of the combined action chamber 3 is a winding 45 which is capable of generating a centered electromagnetic field within the chamber 3. Furthermore, and also outside of the chamber 3, there is provided a piezoelectric transducer 41, fed from the feed system 42 and adapted to generate a cavitation action sustantially concentrated on the ejection point of the injector 28 and such as to produce a very high specific power mechanical cavitation with the glow discharge points (point effect) being utilized according to the particular geometry selected and even with a high tension arc. Said piezoelectric transducer 41, however, while contributing to the homogenization and atomization action of the fluid being treated, is not essential to the invention. The outlet from the combined action cavitation chamber 3 comprises a resonant block 32, similar to 21, having a high vacuum inlet tunnel 23 and an expansion chamber 34 which, through the elastic joint 35, leads into the second, mechanical action cavitation chamber 4 through the inlet assembly 36 thereof. The inlet assembly 36 is quite similar to the resonant body 25, and includes a compression chamber 50, ejection tunnel 51, and injector 52. Finally, the outlet from the cavitation chamber 4 comprises a resonant body 37, similar to the former bodies and having a suction tunnel 53 and an expansion chamber 58 leading into the conduit 38.

The apparatus illustrated in FIG. 1 operates as follows. The primary fluid, comprising fuel oil, naphta, or other thick fuels, is introduced into the apparatus through the conduit 5, whereas the secondary fluid, e.g. water, is introduced through the conduit 6. The primary fluid may be a fuel having a lower viscosity than Diesel oil or even higher than the average viscosity of a fuel oil, i.e. a viscosity up to and above 60° E at 50° C. Said fluid comes from the force pump provided in the combustion system at a pressure in the 0.2 to 0.5 bar range, up to pressures on the order of 120–150 bars. The operating pressure selected is adjusted to the characteristics of the fuel forcing system. The secondary fluid is admitted into the conduit 6 after undergoing suction by an electric metering displacement pump, e.g. from the water supply. The ratio of the primary fluid to the secondary fluid is selected in accordance with the apparatus application. In general, when the system is applied in conformity with the arrangement called of direct application (shown in FIG. 2), the fuel/water ratio is determined according to the fuel forcing pressure, as supplied by the burner, and to the size of the burner atomizers taking into account the direct proportionality existing between theoretical flow rate and theoretical pressure of the displacement pump and the actual flow rate with respect to the actual pressure of the burner forcing assembly. When instead the system is applied in conformity with the arrangement called of indirect application (shown in FIG. 3), the ratio of the primary fluid to water is determined according to the specific fuel. In any case, the flow rate, as regulated by means of an adjustable rate displacement pump, remains unaltered after installation of the apparatus. Once sucked up by the displacement pump, the secondary fluid reaches the precavitation chamber, formed within the body 14, wherein it is pretreated and altered thanks to the presence of the electromagnetic circuit which generates a centered corridor within the chamber itself. The resonant body 14 is fabricated from a magnetizable material with suitable geometry and thicknesses for high pressures to achieve the desired effects. In some cases the resonant body 14 may be also provided with further circuitry to enhance the dissociative effect on the water molecule. Then, the pretreated secondary fluid is admitted at a high pressure (as an average, on the order of 20–30 bars) into the primary chamber where it meets the primary fluid and homogenizes therewith. That chamber, thanks to the particular geometry thereof and the arrangement of the inlets, affords a swirling pattern at the center whereof a corridor of mechanical origin is formed which gradually draws the atomized product toward the expansion chamber 23, whence through the compression chamber 25 it is sent into the combined action cavitation chamber 3. Said chamber is fabricated from a magnetizable material of suitable thickness and geometry such as to eliminate any air bubbles which could form at the beginning of the cycle. The fluid entering the cavitation chamber 3 is maintained at very high pressures, due to the previous pressures of 20–30 bars and the additional action of the electromagnetic field generated by the winding 45 which is centered to the corridor which forms between the injector 28 and inlet to the channel 33.

In particular, the treated fluid is subjected inside the chamber 3 to a turbine effect, i.e. subjected to high instantaneous vacua at the time of entering the expansion chamber followed by just as high instantaneous pressures obtained by the effect of the backpressures, on the order of 100 bars above, along the path which extends from the inlet to the cavitation chamber to the outlet therefrom. The expansion chamber 3 may have a variable length in accordance with the fluid to be atomized and may be provided with a piezoelectric transducer assembly 41 operating at a frequency of 25 kHz with wave trains focussed on the fluid inlet point to the chamber 3. Lastly, the fluid thus treated is passed into the second, mechanical action cavitation chamber 4, which completes the fluid atomization and homogenization effect.

Figure 2:
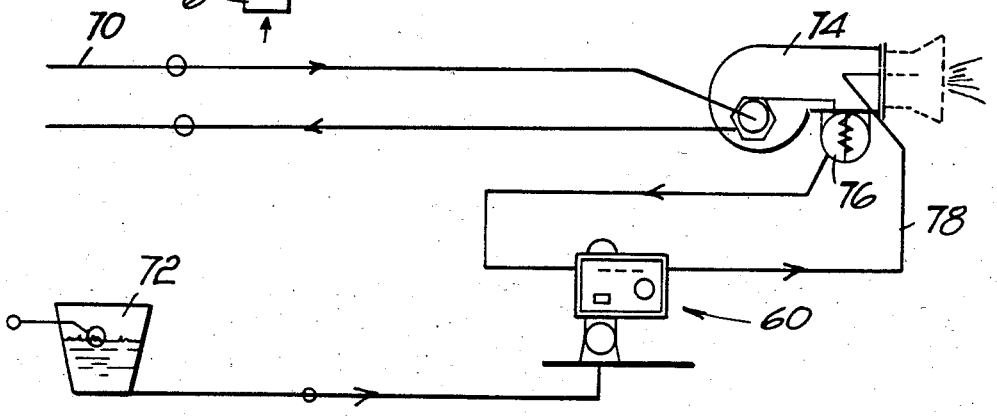
FIG. 2 shows an installation method of the direct type for the apparatus according to the invention.
Figure 3:
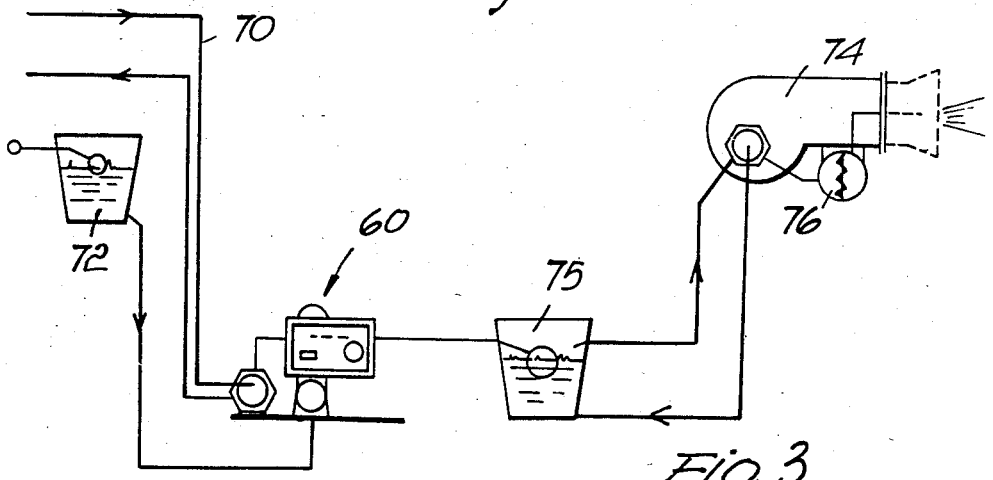
FIG. 3 shows an indirect installation layout for the apparatus according to the invention.

Shown in FIGS. 2 and 3 is the installation of an apparatus 60 of the type illustrated in FIG. 1, respectively of the direct type and indirect type. In FIG. 2, the fuel is supplied on the line 70, heated in the heating device 76, and fed into the apparatus 60 whereto water from a container 72 is also delivered. Then, the atomized liquid is sent on the line 78 and supplied directly to the burner 74. It should be noted that in such a case, in the tank containing the primary fluid, there never occurs return of the atomized product both owing to typical expedients provided in the primary fluid circuit and specific expedients with which the apparatus is endowed.

In FIG. 3, the fuel coming from the line 70 is emulsified and atomized with the water from the storage tank 72 within the apparatus 60, and then delivered to a storage tank 75 whence the burner 74 will arrange for the picking up of the pretreated liquid and its heating in the device 76.

Figure 4:
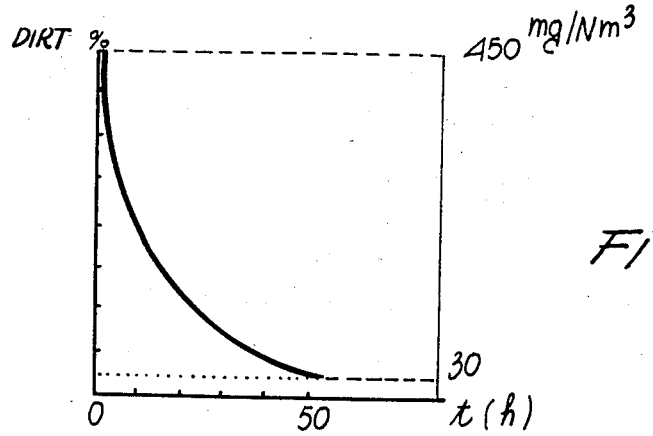
FIGS. 4–6 are graphs showing the behavior of some variables connected with the operation of the apparatus in comparison with apparata of conventional design.
Figure 5:
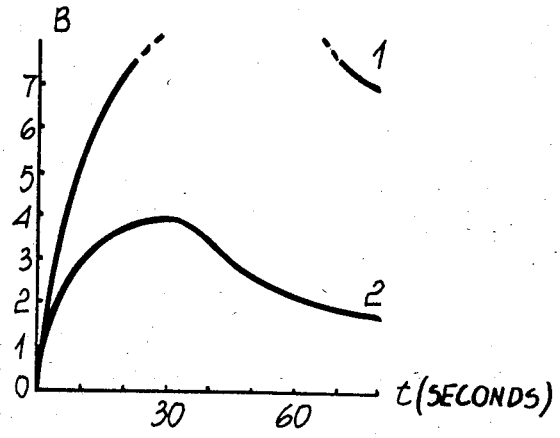
Figure 6:
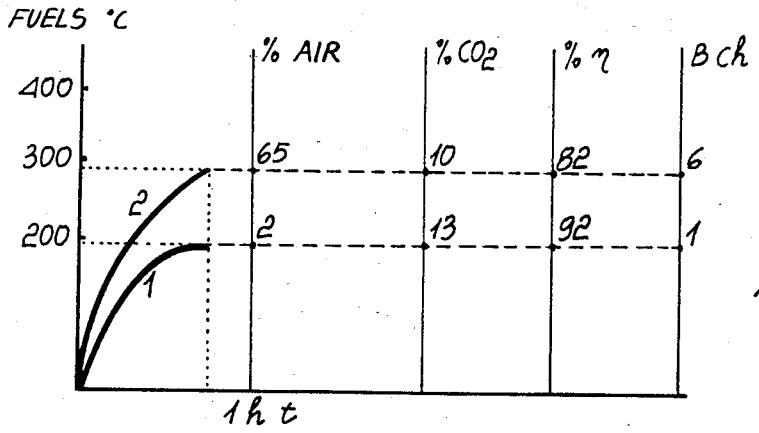

In FIGS. 4–6, there are shown some parameters relating to the operation of the apparatus according to the invention. In particular, FIG. 4 shows the self-cleaning behavior of a boiler with atomized fluid at 35% water and average fuel (15°–20° E at 50° C. type). At the beginning of the test, the boiler is fouled with a dirt level of 2 mm shown as one hundred percent. At the end of the test, as brought out by FIG. 4, after about 50 hours of operation, the atomized fluid has cleaned out the boiler and the escaping solid particles have dropped from 400 mg/Nm$^3$ (combustion without atomization of the fluid) down to values below 30 mg/Nm$^3$.

FIG. 5 illustrates instead the analysis of the combustion beginning and average behavior of a flame smoke emission with a product atomized at 35% water (curve 2) and excess air reduced by 98% over a well conducted flame without atomized product but over 65% excess air (curve 1).

FIG. 6 shows instead a recapitulative graph of different parameters relating to the behavior of the apparatus according to the invention (curve 1) and a system without fluid atomization (curve 2) in particular the graph shows the smoke temperatures in degrees centigrade, the excess air percentage, the percent emission of carbon dioxide, efficiency, and Bacharach index of grade of smoke.

As may be appreciated from the foregoing description, the invention fully achieves its objects. In fact, an apparatus has been provided which affords improved fuel economy, it allowing for water percentages which may reach as much as 60%. This unexpected result, yet to be fully understood, is thought to originate from an effect of dissociation of water into the individual components, which is revealed owing to the very low percentage of the excess air consumed during the combustion.

The apparatus according to the invention has a very high grade of homogenzation and long lasting, very high stability which allows the homogenized fluid to be stored for long periods of time prior to its use without it requiring any further homogenization treatment prior to use. In particular the revealed stability is even multiannual in the instance of fuel oils while Diesel fuel may require a simple mechanical activation action to instantaneously re-compose the original stability.

The apparatus according to the invention further provides for a high self-cleaning behavior, as is brought out by experiments carried out which gave the results shown in FIG. 5.

Furthermore, it should be underlined that, owing to the particular homogeneity of the fluid atomized by the apparatus according to the invention, the temperature of the flue gases is at all times controllable, as is the dewpoint and consequently the production of sulphuric acid and nitrogen oxide may be ruled out. For completeness sake, it is pointed out that the first cavitation chamber 2 comprises a T-like body of AISI Series steel and that the cover and base box-like body are firmly connected through self-locking screws and the joined parts are sealed and sealed with lead because the components and circuitry have considerably high safety and reliability characteristics. The circuit system 52 comprises a panel operating at primary voltages of 220 V single-phase at 50–60 Hz or at 115 V single-phase at 50–60 Hz or at direct voltages of 6-12-24-48 V. The feeding circuit comprises a transistorized amplifier and current step-up circuits and feedback circuits suitably connected. The box-like body comprises a sound deafening and heat absorbing material, of an antifire material, having average depth dimensions of 30×230×110 mm. The cavitation chambers are housed in said box-like body embedded in an Araldite material or selfcuring cements of either the rigid or plasatic types, even water soluble ones. Of course, from the embedded surface the electric circuit terminals would stand out which are connected to the power supply circuit located on the cover of the box-like body.

The invention as disclosed is susceptible to many modifications and changes without departing from the scope of the inventive idea.

Furthermore, all of the details may be replaced with other, technically equivalent elements.

I claim:

1. An apparatus for emulsifying and atomizing fluid fuels with secondary fluids, in particular water, comprising separate inlets for the fluid fuel and secondary fluids to be emulsified together, and mechanical cavitation chambers, at least one combined mechanical and electromagnetic action cavitation chamber adapted to generate within the chamber itself a centered corridor wherethrough said fuels, fluid and secondary fluid, as already mixed together, are caused to flow, wherein the inlet for the secondary fluid comprises a resonant body of a magnetizable material, said body being immersed in a magnetic field generated by external windings to said body and adapted to generate a centered corridor.

2. An apparatus according to claim 1, characterized in that provided upstream of said secondary fluid inlet is a metering displacement pump whose flow rate is set according to the preset ratio of fluid fuel to secondary fluid.

3. An apparatus for emulsifying and atomizing fluid fuels with secondary fluids, in particular water, comprising separate inlets for the fluid fuel and secondary fluids to be emulsified together, and mechanical cavitation chambers, at least one combined mechanical and electromagnetic action cavitation chamber adapted to generate within the chamber itself a centered corridor wherethrough said fuels, fluid and secondary fluid, as already mixed together, are caused to flow, wherein said combined action cavitation chamber comprises a resonant inlet body for the pretreated fluid coming from said first cavitation chamber, said body having at its inlet a compression chamber for said pretreated fluid and an injection nozzle for the fluid thus compressed, said chamber being wrapped in a circuit adapted to generate a magnetic field within said chamber, and being further provided with an outlet for the treated fluid which includes a resonant body penetrated by a conduit formed by a first zone with a given first cross-section and a second zone with a second cross-section larger than the first and forming an expansion chamber for the treated fluid.

4. A method of emulsifying and atomizing fluid fuels with secondary fluids, in particular water, characterized in that it comprises the steps of:

subjecting the secondary fluid to a pre-treatment action of a mechanical type, by causing said fluid to flow through a centered high pressure corridor;

mixing said pretreated secondary fluid with the fluid fuel subjecting them to mechanical cavitation by expansion and compression, thus obtaining a pretreated mixed fluid;

atomizing said pretreated mixed fluid subjecting it to a mechanical-electromagnetic combined action due to high successive instantaneous vacua and pressures in centered corridors obtained by mechanical and electromagnetic effect, thus obtaining a treated fluid;

subjecting the fluid thus treated to a further treatment action of the mechanical type by expansion and compression so as to obtain a perfectly atomized fluid.

* * * * *